United States Patent [19]

Čech et al.

[11] 4,433,705

[45] Feb. 28, 1984

[54] PICKING CHANNEL FOR A JET LOOM

[75] Inventors: Miloslav Čech, Brno; Vladimír Kuda, Blažovice; Vladimír Vašíček, Moravský Krumlov, all of Czechoslovakia

[73] Assignee: Vyzkumny a vyvojovy ustav Zavodu vseobecneho strojirenstvi, Brno, Czechoslovakia

[21] Appl. No.: 190,730

[22] Filed: Sep. 25, 1980

[30] Foreign Application Priority Data

Oct. 3, 1979 [CS] Czechoslovakia ..... 6677-79

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 4,190,067 2/1980 Kuda et al. ..... 139/435

FOREIGN PATENT DOCUMENTS 1941550 2/1970 Fed. Rep. of Germany ..... 139/435

1561949 3/1980 United Kingdom ..... 139/435

*Primary Examiner*—Henry Jaudon

[57] ABSTRACT

A picking channel for pneumatic jet looms with auxiliary blowing sections disposed across the weaving width and consisting of at least three auxiliary blowing nozzles the relative positions of the axes of which being those of skew lines with the axis of the first auxiliary blowing nozzle crossing the axis of the weft thread under insertion. The axes of the other auxiliary blowing nozzles pass said axis of the weft thread under insertion of the outside, in the direction of the axis of the first auxiliary blowing nozzle. The various dispositions of both the auxiliary blowing sections and nozzles insure reliable weft insertion, and economic exploitation of the energy of the carrier medium and, consequently, a greater weaving width.

9 Claims, 8 Drawing Figures

PICKING CHANNEL FOR A JET LOOM

The invention relates to a picking channel for a jet loom for picking a weft thread through the warp shed by means of a jet of a fluid carrier medium.

In known jet looms in which air is used as a carrier medium for picking the weft thread through the wrap shed, the picking is performed by means of a main nozzle disposed within the axis of the weft thread under insertion. In this simplest of cases the picking channel is formed of upper and lower sheets of wrap threads and reed dents. In view of undesirable losses in the velocity of the air jet and, consequently, a low efficiency in picking of the weft thread through the warp shed, auxiliary blowing nozzles are used, such auxiliary nozzles being disposed along the path of the weft thread under insertion and oriented in the picking direction.

As a rule, these auxiliary nozzles constitute secondary sources of the carrier medium, by means of which the main jet of the carrier medium is complemented and influenced. The axes of a group of the auxiliary blowing nozzles intersect at one or more points within the axis of the weft thread under insertion. It is known that the auxiliary blowing nozzles have the form of projections or pins and are attached, for example, to a reed beam by means of which they are moved through the warp threads so that on their backward movement they penetrate into the warp shed and on the beat-up movement they move out of it. Further, an arrangement of auxiliary blowing nozzles is known wherein the auxiliary blowing nozzles endeavor, by means of their air jets, to define a confined zone, i.e. a picking channel, within the warp shed for weft thread picking.

Also mechanical means are known serving for the closer delimitation of the picking channel within the warp head. Usually a picking channel is used which is assembled of guiding teeth each of which is provided with a tapering passage aperture to direct the jet centripetally of the carrier medium, and an exit slot is provided to let out the inserted weft thread. Among the guiding teeth disposed in this way on the reed beam and across the whole picking length there are interposed the auxiliary blowing nozzles, which are frequently formed in some of the guiding teeth of the picking channel.

In practical use, however, none of the described solutions provides to a sufficient extent a reliable picking of the weft thread through the warp shed, nor an economical exploitation of the carrier medium energy, and they restrict the working width of the loom.

The above disadvantages and shortcomings are to a considerable extent eliminated by the picking channel for picking of weft threads through the warp shed by means of a jet of a carrier medium according to the invention. In accordance with the invention, at least one auxiliary blowing section is disposed on at least one side of the weft thread under insertion, such section consisting of at least three auxiliary blowing nozzles the axes of which constitute skew lines, with the axis of the first auxiliary blowing nozzle intersecting the axis of the weft thread under insertion, and the axes of the remaining auxiliary blowing nozzles of the auxiliary blowing section passing the axis of the weft thread under insertion on the outside in the direction of the axis of the first auxiliary blowing nozzle.

The main advantage of the picking channel according to the invention resides, in the first place, in a considerable increase of reliability in picking the weft thread through the warp shed, i.e. particularly a reduction of short picks and other faults in the fabric. The weaving process is then more continuous and of higher productivity, since the energy of the carrier medium is also better exploited. Another advantage resides in the posibility of increasing the working width of the loom.

Exemplary embodiments of the invention are shown in the accompanying drawings, in which.

Figure 1:
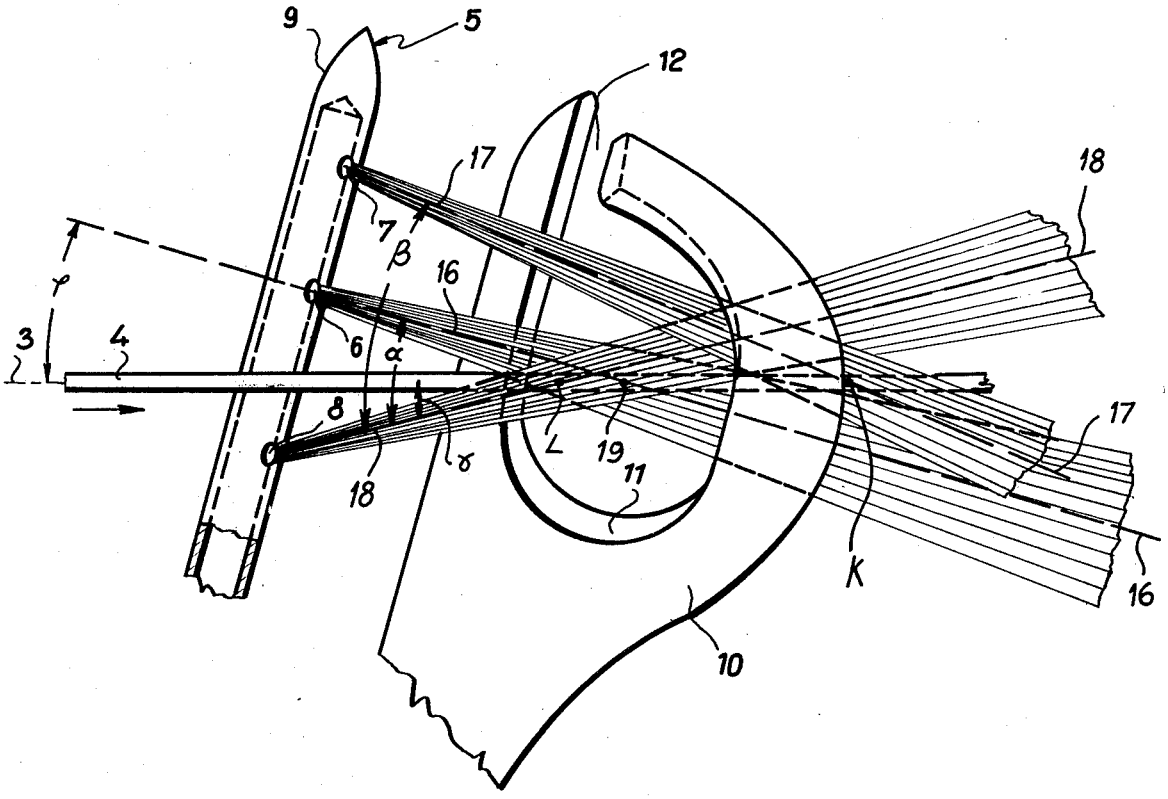
FIG. 1 is a diagrammatic perspective representation of a portion of a picking channel according to a first exemplary embodiment of the invention.

As shown in FIGS. 1, 2, 3 and 4, which illustrate the first exemplary embodiment, at least one auxiliary blowing section 5 is disposed on a beam 1 of (FIG. 3) a reed of 2 of a pneumatic loom, not shown in greater detail, along one side of the axis 3 of a weft thread 4 under insertion. In this exemplary embodiment the auxiliary blowing section 5 is formed with at least three auxiliary blowing nozzles 6, 7, and 8 which are disposed one above the other on a hollow body 9, such nozzles being oriented in the picking direction. The body 9 has a substantially cylindrical form with a pointed tip.

Figure 2:
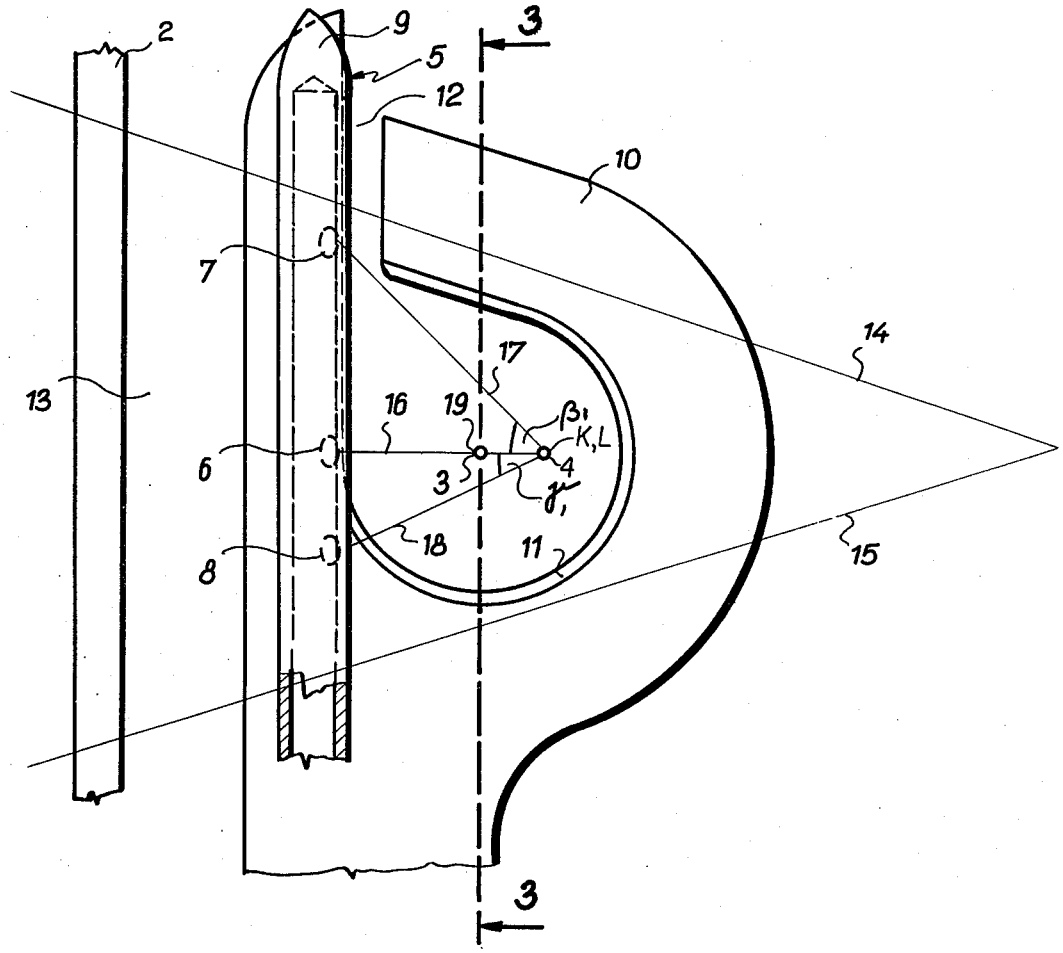
FIG. 2 is a view in elevation of the embodiment of picking channel shown in FIG. 1, the view being taken from a vertical plane parallel to the broad extent of the tooth shown in FIG. 1 disposed upstream or to the left of such tooth.
Figure 3:
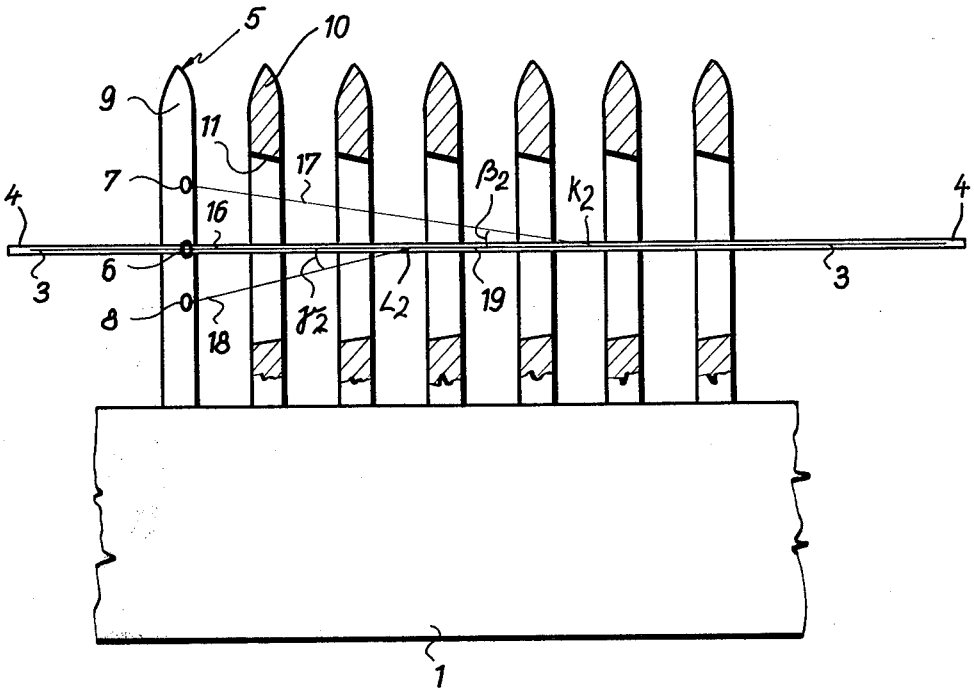
FIG. 3 is a view partially in vertical longitudinal section through a portion of the picking channel of FIG. 1, the section being taken along the line 3—3 in FIG. 2.
Figure 4:
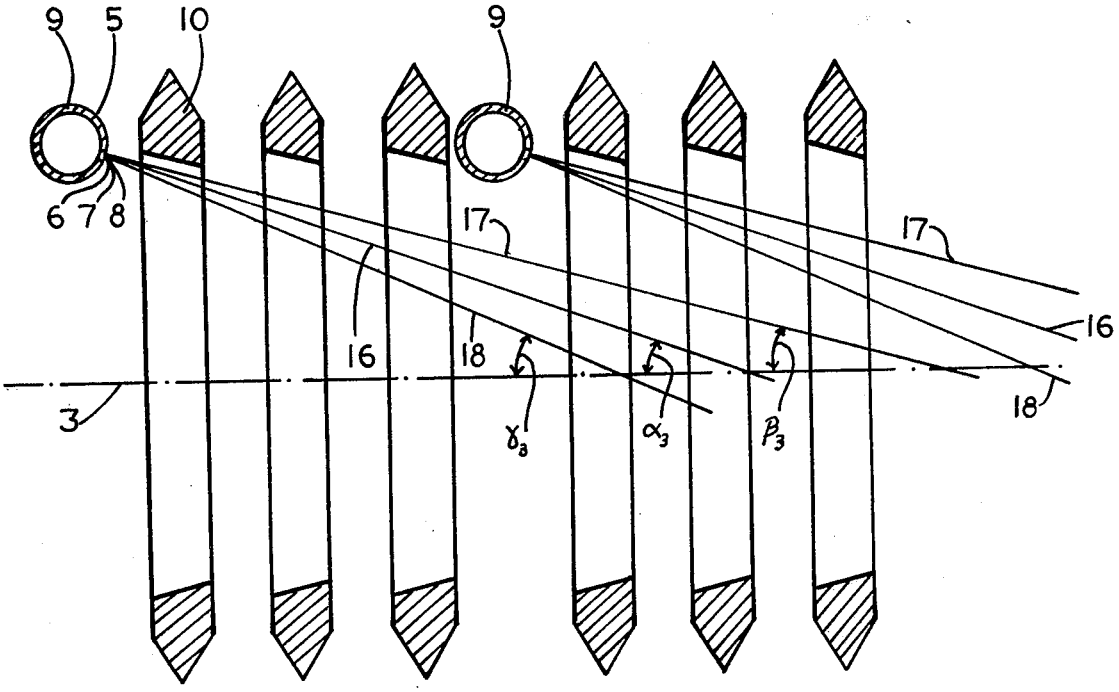
FIG. 4 is a diagrammatic view in longitudinal horizontal axial section through a portion of the picking channel of FIGS. 1, 2, and 3.

As shown in FIG. 3, on the beam 1 of the reed 2, there are advantageously mounted, together with the auxiliary blowing section 5, picking teeth 10 each of which is provided with a tapered passage aperture 11 to centripetally direct the jet of a carrier medium, and an exit slot 12, (FIG. 2) to let out the inserted weft thread 4. The picking teeth 10 orient both the main jet of the carrier medium, for example pressure air, which at the moment of picking issues from a main nozzle, not shown, in the picking direction of the weft thread 4, and the additional jets of the carrier medium issuing from the auxiliary blowing nozzles 6, 7, 8. At the moment of picking of the weft thread 4, the auxiliary blowing nozzles 6, 7, 8 and the picking teeth 10 are plunged in the open warp shed 13, (FIG. 2) defined by upper and lower warp threads 14, 15, respectively, and the reed 2. With reference to the auxiliary blowing section 5, it should be noted that the axes 16, 17, 18 of the auxiliary blowing nozzles 6, 7, 8, respectively, constitute skew lines, with the axis 16 of the first auxiliary blowing nozzle 6 intersecting the axis 3 of the weft thread 4 under insertion at a point 19. The axes 17, 18 of the other auxiliary blowing nozzles 7, 8, respectively, do not intersect axis 3, and pass outside the axis 3 of the weft thread 4 under insertion, in the direction of the axis 16 of the first auxiliary blowing nozzle 6, as particularly shown in FIG. 1. As shown in FIG. 1, the axis 16 of the nozzle 6 forms in space an angle $\alpha$ (alpha) with respect to the axis 3, the axis 17 of the nozzle 7 forms an angle $\beta$ (beta) in space with respect to the axis 3, and the axis 18 of the nozzle 8 forms an angle $\gamma$ (gamma) in space with respect to the axis 3.

Further, advantageously, as shown in FIG. 3, one of the axes, for example the axis 18 of the auxiliary blowing nozzle 8, passes the axis 3 of the weft thread 4 under insertion before the point of intersection 19 of the latter with the axis 16 of the first auxiliary blowing nozzle 6, and the other axis, for example the axis 17 of the auxiliary blowing nozzle 7, passes the axis 3 of the weft thread 4 under insertion after said point of intersection 19, as viewed in the picking direction, (to the right) of the weft thread 4.

In the embodiment of FIGS. 1–4, incl., the auxiliary blowing nozzles 6,7 and 8 are disposed one above the other on one body 9 only; as above noted, the axis 16 of the auxiliary blowing nozzle 6, which intersects the axis 3 of the weft thread 4 under insertion at 19, forms in space with said axis 3 an angle $\alpha$ (alpha). In a preferred example, alpha equals 3 degrees. The angle$\alpha$ (alpha) lies within the range of the greatest and smallest angle in space $\beta$ (beta), and $\gamma$ (gamma) which are included in space between the axes 17, 18, respectively, on the one hand, and the axis 3 of the weft thread 4 under insertion. In such preferred example the angle $\beta$ (beta) equals 5 degrees and the angle $\gamma$ (gamma) equals 3 degrees. It is to be noted that the angles $\beta_1$ and $\gamma_1$ (beta$_1$ and gamma$_1$), respectively, shown in FIG. 2, are horizontal projections of the angles $\beta$ and $\gamma$ (beta and gamma), respectively, upon a vertical transverse plane, that the angles $\beta_2$ and $\gamma_2$ (beta$_2$ and gamma$_2$), shown in FIG. 3, are projections of the angles $\beta$ and $\gamma$ (beta and gamma) upon a vertical longitudinal plane, and that the angles $\alpha_3$, $\beta_3$ and $\gamma_3$ (alapha$_3$, beta$_3$ and gamma$_3$) are vertical projections of the space or solid angles $\alpha$, $\beta$ and $\gamma$ (alpha, beta and gamma), respectively, upon a horizontal longitudinal plane.

In FIG. 1 the apparent but not actual intersection of jet axis 17 with the axis 3 of weft 4 is designated K, and the apparent but not actual intersection of jet axis 18 with the axis of weft 4 is designated L. In FIG. 2 the apparent (not actual) intersection of jet axes 17 and 18 with the axis 3 of weft 4 is designated $K_1$, $L_1$. In FIG. 3 the axis 17 intersects a plane containing axis 3 of weft 4 which is normal to the plane of the paper at point $K_2$, and the axis 18 intersects such plane at point $L_2$.

Figure 5:
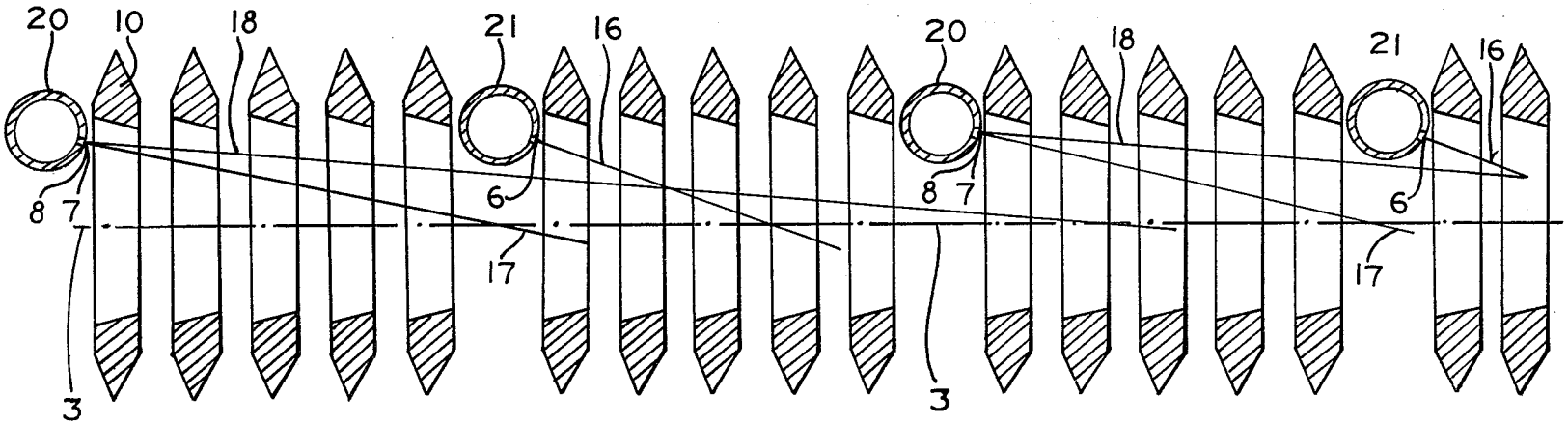
FIG. 5 is a diagrammatic view in longitudinal horizontal axial section through a portion of a second embodiment of picking channel in accordance with the invention, such second embodiment being a modification of the first embodiment.

However, the auxiliary blowing nozzles 6, 7, 8 of one section 5 need not be disposed on one body 9 only. In FIG. 5, the second embodiment, shown in the nozzles 6, 7, 8 are disposed on two bodies 20, 21. In this case the first nozzle 6 is disposed on the body 21 and the other nozzles 7, 8 are disposed on the body 20. Analogously, each of the auxiliary blowing nozzles 6, 7, 8 may be disposed on a separate body. The projected angles $\alpha_3$, $\beta_3$ and $\gamma_3$ (alpha$_3$, beta$_3$ and gamma$_3$) in FIG. 5 are the same as the similarly designated projected angles in FIG. 4.

Figure 6:
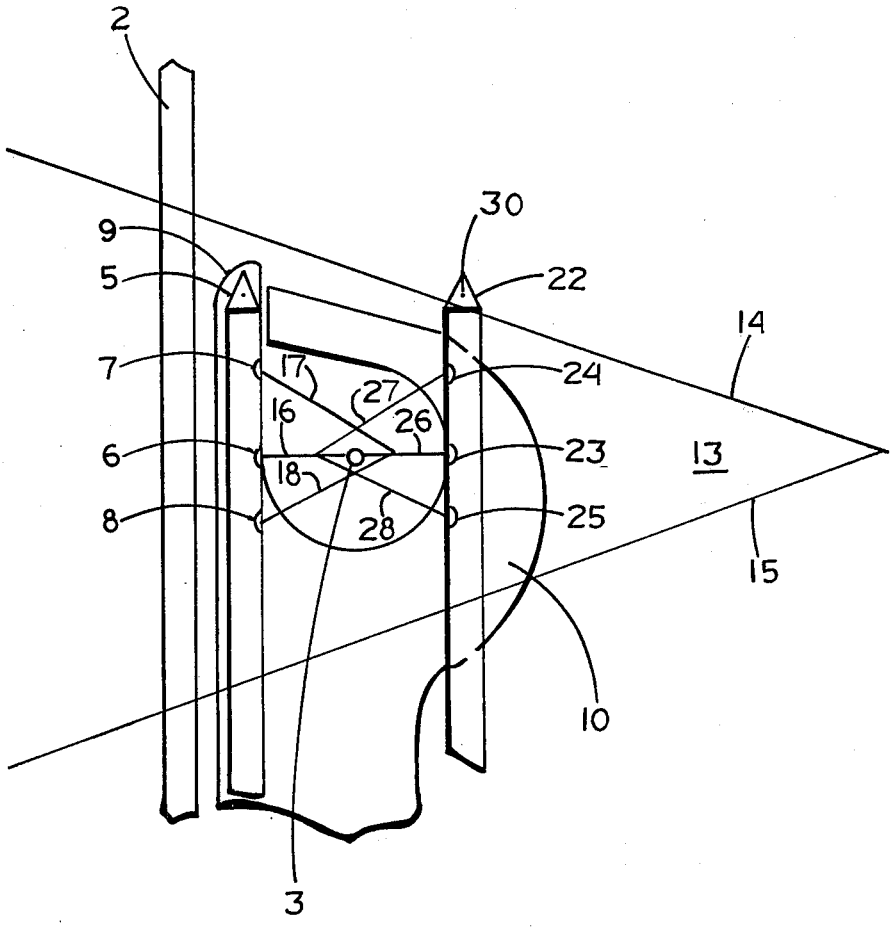
FIG. 6 is a view similar to FIG. 2 of a third exemplary embodiment of a portion of a picking channel as seen in the picking direction of the weft thread.
Figure 7:
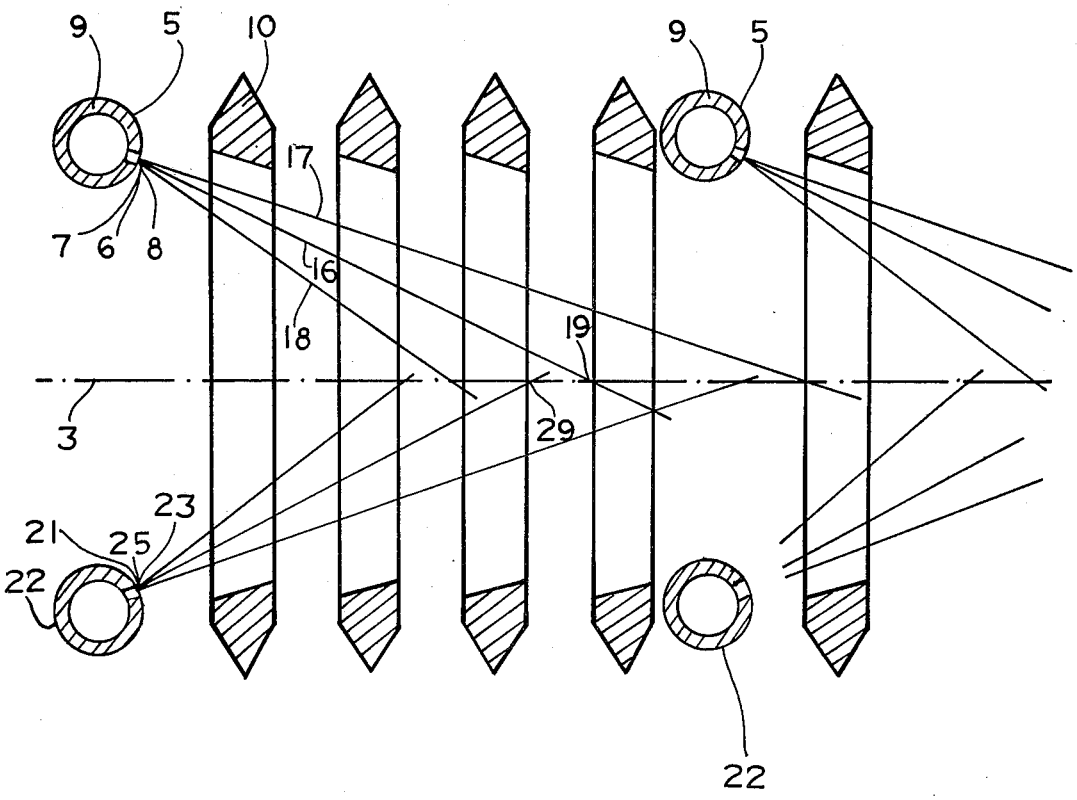
FIG. 7 is a diagrammatic view in longitudinal horizontal axial section through a portion of the picking channel of FIG. 6.
Figure 8:
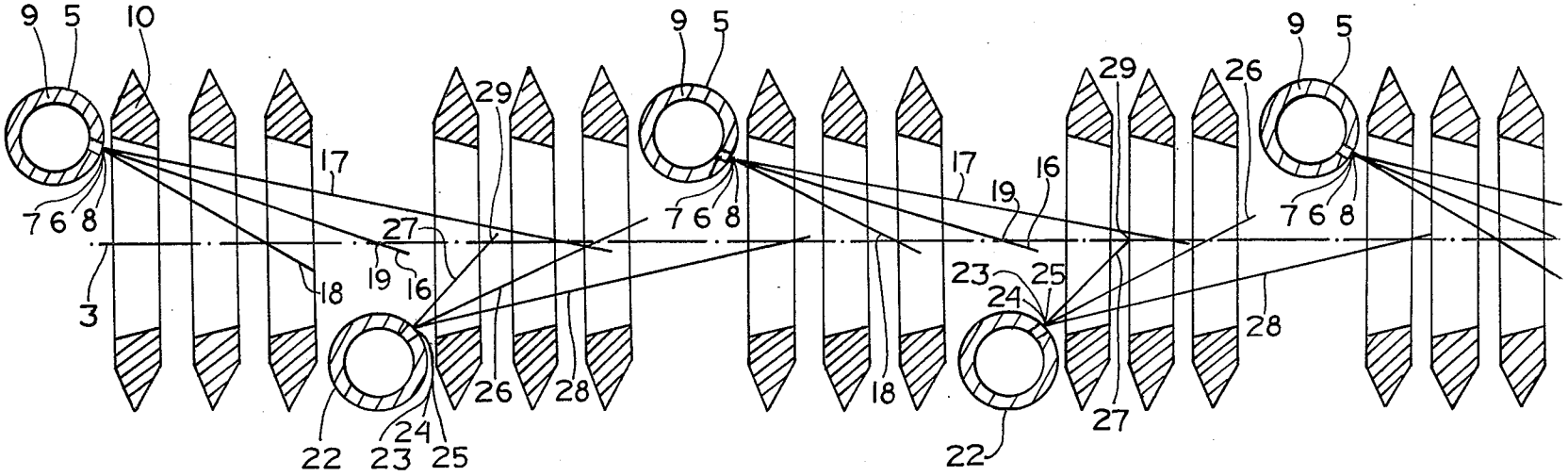
FIG. 8 is a diagrammatic view in longitudinal horizontal axial section through a fourth embodiment of the picking channel in accordance with the invention, such fourth embodiment being a modification of FIG. 6.

In the third exemplary embodiment, shown in FIGS. 6 and 7, there are at least two auxiliary blowing sections 5, 22, one each on one side of the axis 3 of the weft thread 4 under insertion. The embodiments of the sections 5 and 22 correspond to those previously described, section 5 being the same as before, and section 22 having a body 30 on which there are disposed auxiliary blowing nozzles 23, 24, 25 having axes 26, 27, 28 respectively, auxiliary nozzles 23, 24 and 25 being laterally inverted with respect to the nozzles 7, 6, and 8, respectively, of section 5. However, it is convenient for the axes 16 and 26 of the first auxiliary blowing nozzles 6 and 24 respectively, to intersect the axis 3 of the weft thread 4 under insertion at two different points 19 and 29, respectively. In this embodiment the pair of auxiliary blowing sections 5 and 22 are disposed in one plane at right angles to the axis 3 of the weft thread 4 under insertion, as shown. In FIG. 6 the projected angles upon a vertical transverse plane are designated respectively $\beta_1$ and $\gamma_1$ (beta$_1$ and gamma$_1$), as in FIG. 2, whereas in FIG. 7 the projections of the various angles upon a horizontal longitudinal plane are designated, respectively, $\alpha_3$, $\beta_3$, and $\gamma_3$ (alpha$_3$, beta$_3$, and gamma$_3$), as in FIG. 4. FIG. 8 illustrates the fourth exemplary embodiment of the invention. In such fourth exemplary embodiment of the invention the auxiliary blowing sections 5 and 22 are disposed in different transverse planes. Within the scope of the invention, the sections 5 and 22 can each also be disposed on a plurality of bodies, as has been described in connection with the first exemplary embodiment of FIGS. 1–4, inclusive. In FIG. 8 the vertical projections of the angles $\alpha$, $\beta$ and $\gamma$ (alpha, beta and gamma) upon a horizontal longitudinal plane are designated $\alpha_3$, $\beta_3$, and $\gamma_3$ (alpha$_3$, beta$_3$, and gamma$_3$), as in FIG. 4.

All of the auxiliary blowing nozzles 6, 7, 8, 23, 24, 25 and/or their associated bodies 9, 20, 21, 30 are connected together with the main nozzle, not shown, to a source of a pressure medium, for example an air compressor, not shown.

It will be readily understood that, as a rule, a plurality of auxiliary blowing sections 5, 22 are distributed across the length of the picking channel, the distances between them not needing to be equal but diminishing in the picking direction.

The invention can be utilized with particular advantage in the picking channels for pneumatic looms of great weaving width.

Although the invention is illustrated and described with reference to a plurality of preferred embodiments thereof, it is to be expressly understood that it is in no way limited to the disclosure of such preferred embodiments, but is capable of numerous modifications within the scope of the appended claims.

We claim:

1. A picking channel for a jet loom for picking a weft thread through the warp shed by means of a jet of a carrier medium, comprising auxiliary blowing nozzles disposed along the path of the weft thread under insertion and directed obliquely into the picking direction of the weft thread, at least one auxiliary blowing section being disposed on at least one side of the weft thread under insertion and formed of at least three auxiliary blowing nozzles the axes of which constituting skew lines, the axis of the first auxiliary blowing nozzle intersecting the axis of the weft thread under insertion, and the axes of the other auxiliary blowing nozzles of the auxiliary blowing section passing the axis of the weft thread under insertion on the outside in the direction of the axis of the first auxiliary blowing nozzle.

2. A picking channel as claimed in claim 1 wherein all of the auxiliary blowing nozzles of an auxiliary blowing section are disposed one above the other on a common auxiliary blowing body.

3. A picking channel as claimed in claim 1, wherein the axis of the auxiliary blowing nozzle, which intersects the axis of the weft thread under insertion, includes with the latter an angle $\alpha$ (alpha) the magnitude of which lies within the range of the greatest and smallest angles $\beta$ (beta) and $\gamma$ (gamma) included by the axes of the other auxiliary blowing nozzles and the axis of the weft thread under insertion.

4. A picking channel as claimed in claim 1 wherein at least one auxiliary blowing nozzle is disposed on one auxiliary blowing body and the other auxiliary blowing nozzles are disposed on another auxiliary blowing body.

5. A picking channel as claimed in claim 1 wherein each of the auxiliary blowing nozzles of at least one auxiliary blowing section is disposed on a separate auxiliary blowing body.

6. A picking channel as claimed in claim 1 wherein at least one pair of the auxiliary blowing sections is disposed in opposite relation on both sides of the axis of the weft thread under insertion, with the axes of the first auxiliary blowing nozzles intersecting the axis of the weft thread under insertion at two different points of intersection.

7. A picking channel as claimed in claim 6, wherein a pair of auxiliary blowing sections is disposed in one plane situated at right angles to the axis of the weft thread under insertion.

8. A picking channel as claimed in claim 6, wherein a pair of auxiliary blowing sections is disposed in at least two planes situated at right angles to the axis of the weft thread under insertion.

9. A picking channel for a jet loom for picking a weft thread through the warp shed by means of a jet of a carrier medium, comprising auxiliary blowing nozzles disposed along the path of the weft thread under insertion and directed obliquely into the picking direction of the weft thread, at least one auxiliary blowing section being disposed on at least one side of the weft thread under insertion and formed of at least three auxiliary blowing nozzles the axes of which constituting skew lines, the axis of the first auxiliary blowing nozzle intersecting the axis of the weft thread under insertion, and the axes of the other auxiliary blowing nozzles of the auxiliary blowing section passing the axis of the weft thread under insertion on the outside in the direction of the axis of the first auxiliary blowing nozzle, the axis of the second auxiliary blowing nozzle passing the axis of the weft thread under insertion before the point of intersection of the axis of the first auxiliary blowing nozzle and the axis of the next auxiliary blowing nozzle passing the axis of the weft thread under insertion after said point of intersection.

* * * * *